US005477712A

United States Patent [19]

Hill

[11] Patent Number: 5,477,712

[45] **Date of Patent: * Dec. 26, 1995**

[54] AUTOMOBILE ANIT-THEFT GUARD PLATE

[75] Inventor: Mark L. Hill, Tucson, Ariz.

[73] Assignee: Hill International, Tucson, Ariz.

[ * ] Notice: The portion of the term of this patent subsequent to Jan. 5, 2009, has been disclaimed.

[21] Appl. No.: 141,801

[22] Filed: Oct. 21, 1993

[51] Int. Cl.[6] ..... E05B 63/00

[52] U.S. Cl. ..... 70/417; 70/418

[58] Field of Search ..... 70/370, 416–418, 70/452, 451, 208; 292/355; 403/407.1, 408.1

[56] References Cited

U.S. PATENT DOCUMENTS

| | | | |
|---|---|---|---|
| 1,480,650 | 1/1924 | Bacon | 70/418 |
| 2,761,721 | 9/1956 | Jakeway | 292/355 |
| 3,036,673 | 5/1962 | Sauterre | 403/407.1 |
| 3,456,968 | 7/1969 | Nichols | 403/407.1 |
| 3,466,072 | 9/1969 | Andrews | 403/407.1 |
| 3,740,980 | 6/1973 | Schimizzi | 70/417 |
| 5,176,016 | 1/1993 | Hill | 70/417 |
| 5,340,174 | 8/1994 | Bender | 70/208 |

FOREIGN PATENT DOCUMENTS

| | | | |
|---|---|---|---|
| 8900231 | 1/1989 | WIPO | 70/419 |

*Primary Examiner*—Steven N. Meyers
*Assistant Examiner*—Gary Estremsky
*Attorney, Agent, or Firm*—Ogram & Teplitz

[57] ABSTRACT

An improved automobile anti-theft guard plate that provides exceptional strength through the use of two bonded plates. The first plate has a flanged circumference to enclose the second plate. These flanges, especially when combined with the second plate's inherit strength, provide for enhanced rigidity to withstand deformation from a pry bar. An opening through both plates permits the automobile's handle lock activation and door opening mechanism access to these mechanisms within the automobile door. A tower or vertical member on the guard plate extends vertically from the plates and at least partially surrounds and shields the handle's mechanisms to even further dissuade tampering by a thief. The guard plate is additionally designed to permit the handle to be secured thereto through the use of tabs which engage the handle at the same time the handle is engaging the opening mechanism. This simultaneous engagement is accomplished through a sliding action of the handle relative to the guard plate and the automobile door.

18 Claims, 2 Drawing Sheets

AUTOMOBILE ANIT-THEFT GUARD PLATE

BACKGROUND OF THE INVENTION

This invention relates generally to automobiles and more particularly to devices which dissuade theft of the automobile.

Theft of automobiles is on the rise and the easiest place for a thief to gain access to a locking mechanism is through the lock cylinder. Typically an automobile's door or trunk has an opening which is used to contain the activator mechanism/lock cylinder to the lock mechanism inside the door or trunk. The activator mechanism, by necessity, requires a hole in the door or trunk. Through this hole, a pry bar such as a screw-driver, is inserted and the interior locking mechanism is accessed.

Recognition of this weakness in the security of an automobile has been around for many years; numerous devices have been developed which attempt to cure this deficiency.

One such device is described in U.S. Pat. No. 4,160,368, entitled "Automobile Trunk Lock Guard" issued to Solow on Jul. 10, 1979. This device provides a security plate which surrounds the lock cylinder. The plate is secured to the vehicle through the use of metal screws.

The use of metal screws requires added complexity in the installation process and also is not aesthetically pleasing. Additionally, the apparatus is unsuitable for a handle situation since the added plate's thickness disrupts the dimensional requirements for the handle to reach the interior locking mechanism.

Another attempt to provide additional security is described in U.S. Pat. No. 4,530,223, entitled "Guard For Key Cylinder" issued to Oliver on Jul. 23, 1985. This apparatus is a metal plate which bolts around the outside surface to protect the key cylinder. Again, the use of bolts are required and the plate is inoperative with a factory built handle.

In both of these situations, strength for the security plate is accomplished by expanding the thickness of the generally flat plate. This additional thickness prevents a thief from buckling or deforming the security plate; but, the added thickness also requires the use of a replacement handle as the factory installed handle is no longer able to reach the door's locking mechanism properly.

Recognizing that the less disruptive a device is to the existing automobile, the more likely the device is to be used, U.S. Pat. No. 4,619,123, entitled "Guard Plate and Method for Automobile Door Handle" issued to Hill on Oct. 28, 1986, and U.S. Pat. No. 5,176,016, entitled "Automobile Handle Guard Plate" issued to Hill on Jan. 5, 1993, were developed.

The Hill apparatus utilizes the existing door handle and places a security plate between the handle and the automobile door. No drilling or exterior screws were needed and all of the existing parts on the automobile still interact with each other.

In certain situations though, the Hill security plate, being substantially a flat metal plate, could be bent or deformed by an aggressive thief and thereby permit access to the interior locking mechanism.

It is clear that there is a need for additional security at the activator mechanism.

SUMMARY OF THE INVENTION

The invention creates an improved automobile anti-theft guard plate that provides exceptional strength through the use of two bonded plates. The first plate has a flanged circumference to enclose the second plate. These flanges, especially when combined with the second plate's strength, provide for enhanced rigidity to withstand deformation from a pry bar.

An opening through both plates permits the automobile's handle lock activation and door opening mechanism access to their related mechanisms within the automobile door. A tower or vertical member on the guard plate extends vertically from the plates and at least partially surrounds the handle's mechanisms to even further dissuade tampering by a thief.

The guard plate is additionally designed to permit the handle to be secured thereto through the use of tabs which engage the handle at the same time the handle is engaging the opening mechanism. This simultaneous engagement is accomplished through a sliding action of the handle relative to the guard plate and the automobile door.

Central to the anti-theft aspects of the invention is the guard plate itself. The guard plate is extremely rigid due to the interaction of the first plate and the second plate. Not only is strength obtained by the layering of the two plates, but the flanges around the periphery of the first plate provide for exceptional strength against bending.

In furtherance of added strength, the preferred embodiment uses condition A 4130 aerospace grade chrome moly alloy for its plate material. This material is especially reluctant to bend and as such further discourages a thief's pry bar.

An opening through the two plates permits the automobile handle easy access to the interior workings of the door. These workings usually include two different mechanisms—the locking mechanism, and the door release mechanism. The door release mechanism secures the door during normal use to prevent it from opening at will. The locking mechanism is used to secure the door release from unauthorized opening.

The guard plate includes a vertical member or tower which is constructed vertically from the plane of the plates. This tower provides additional security in that it protects the locking mechanism from tampering. To accomplish the anti-tampering aspect, the tower encircles or shields selected portions of the locking activation mechanism; in this manner, the locking activation mechanism is shielded from either a pry bar or screw-driver.

Even further, the method that the preferred embodiment is secured to the handle and the door also dissuades tampering. Using a clip mechanism, one side of the guard plate is secured to the automobile's door. At the other side of the guard plate, the tower contains an opening through which a screw or other fastener secures the handle, guard plate and door to each other.

Still further, between the clip and screw fastener, tabs on each side of the opening engage mating tabs on the handle to firmly secure the handle to the guard plate. The engagement of these tabs is through a sliding action between the handle and the guard plate which also simultaneously engages the opening mechanism within the door.

In this manner, the guard plate, handle, and automobile door are easily and securely affixed to dissuade even the most aggressive of thief.

The invention and its various embodiments will be more fully explained by the following drawings and their accompanying descriptions.

DRAWINGS IN BRIEF

DRAWINGS IN DETAIL

Figure 1A:
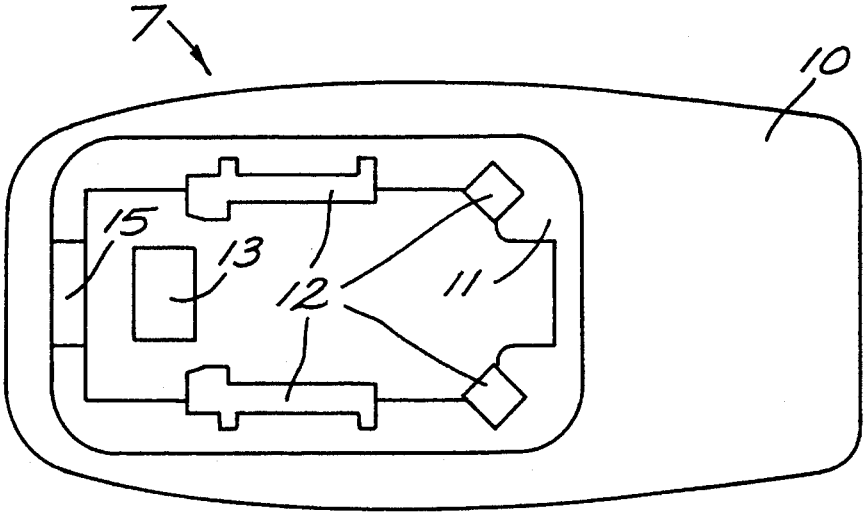
FIG. 1A is a top view of the preferred embodiment of the guard plate with clip.

FIG. 1A is a top view of the preferred embodiment of the guard plate with clip.

First plate 10 is the exposed plate of the guard plate 7. It covers the second plate 11 leaving part of second plate 11 exposed through opening 14. Vertical member 12, which acts as a protective collar, is attached to the first plate 10 and second plate 11 via tabs as illustrated. Although the main body of vertical member 12 would be visible in this illustration, it is not shown for clarity of view.

Second plate 11 has clip portion 15 indented for receipt of clip 13. Clip 13 is used to secure and attach guard plate assembly 7 to the body of the automobile.

The three components of the guard plate 7, (first plate 10, second plate 11, and vertical member 12) are bonded together through a variety of techniques well known to those of ordinary skill in the art including adhesives, copper brazing, and the like.

Guard plate 7 and clip 13 compose a kit which is delivered to the mechanic for retrofit of the guard plate onto the automobile. In this manner, existing automobiles are made more secure for minimal expense.

Figure 1B:
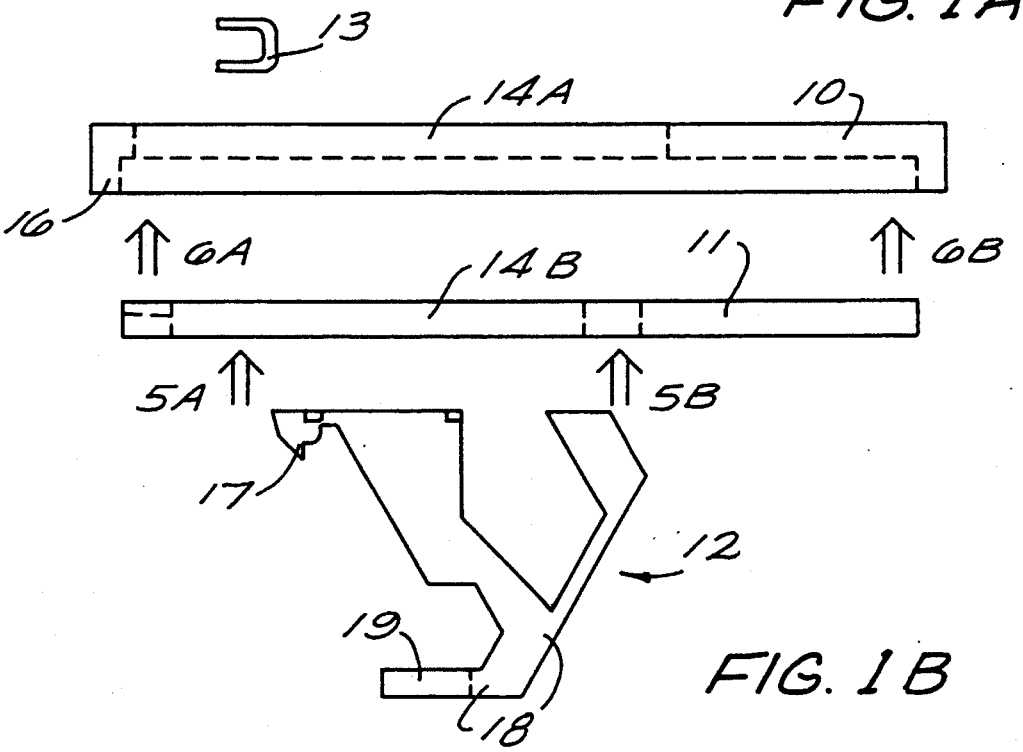
FIG. 1B is an exploded side view of the preferred embodiment of the guard plate with clip.

FIG. 1B is an exploded side view of the preferred embodiment of the guard plate with clip.

First plate 10 has opening 14A therein and flanges 16. Flanges 16 are used to create added strength and, in the preferred embodiment, totally surround second plate 11 once it has been placed into the recess created by flanges 16 and as illustrated by arrows 6A and 6B.

Second plate 11 has opening 14B which permits access therethrough for the workings of the automobile handle.

Vertical member/tower 12 attaches to first plate 10 and second plate 11 as shown by arrows 5A and 5B. Vertical member 12 is constructed to have enclosing section 18 with opening 19 which is designed to partially encircle the locking mechanism from the automobile handle.

Tabs 17 (only one seen in this view) are also used to secure the handle to the guard plate assembly 7.

Figure 1C:
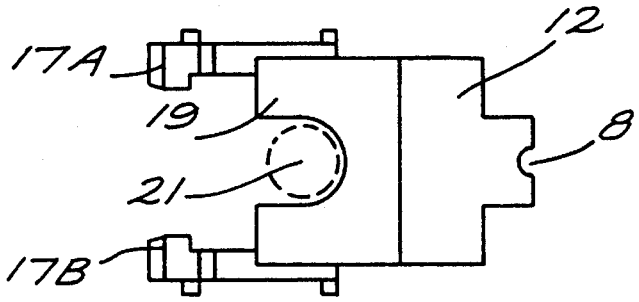
FIG. 1C is a bottom view of the preferred embodiment's tower or vertical member.

FIG. 1C is a bottom view of the preferred embodiment's tower or vertical member.

In this view, tabs 17A and 17B are easily seen. These tabs 17A and 17B lock onto a protrusion from the automobile handle (not shown in this figure but is element 30 of FIG. 2). Opening 19 partially surrounds the mechanics of the locking mechanism 21 from the handle. This prevents a pry bar or screw-driver from gaining access to the locking mechanism and thence access to the vehicle.

Figure 2:
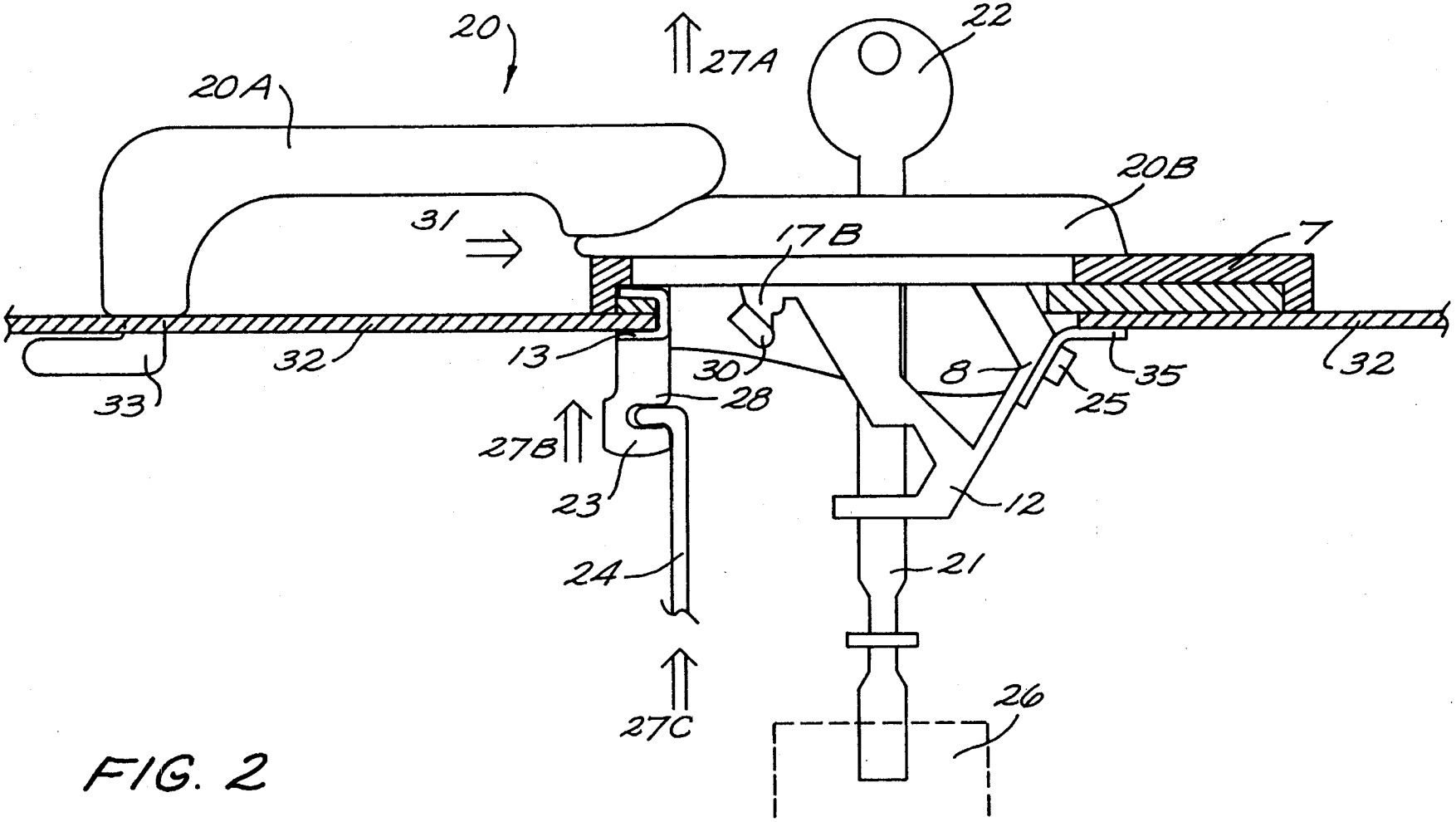
FIG. 2 is a cutaway side view of the preferred guard plate mounted with an automobile door handle onto an automobile's door.

Screw opening 8 is also used to secure the tower 12 to the automobile handle assembly and is better seen and described in FIG. 2.

FIG. 2 is a cutaway side view of the preferred guard plate mounted with an automobile door handle onto an automobile's door.

Plate assembly 7 is placed on the automobile door 32 so that the vertical member/tower 12 extends into the interior of the door. In this example, a portion of door 32 is not shown in close proximity to the guard plate for ease of description.

Handle 20 has a moveable section 20A and a fixed section 20B. Moveable section 20A is affixed at one end to the door 32 via tab 33 which extends into the interior of the door, and at the other end via fixed section 20B.

Installing the assembly requires a first step of placement of the guard plate 7 into the proper opening in door 32. Clip 13 is used to affix one end of guard plate 7 to the door 32.

Handle 20 is inserted into the respective holes and the lock activation mechanism 21 is engaged with locking mechanism 26. Lock activation mechanism 21 is rotated through operator activation of key 22.

Handle 20 is then slid, as shown by arrow 31, to simultaneously engage tabs 30 with tabs 17B and door opening mechanism 24 with clasp 28. This simultaneous engagement permits easy installation. In operation, when moveable section 20A is rotated, as illustrated by arrow 27A, this causes a like motion in clasp 28 and connector 23, illustrated by arrow 27B pulling on opening mechanism 27C which causes the automobile's door to open.

Screw 25 is then applied to engage bracket 35 through a fastener opening, tower 12 (via slot 8) and the handle into one secure assembly. Note that guard plate 7 is secured to the automobile's door via both clip 13 and screw 25.

In this manner, the automobile handle is quickly and securely installed onto the vehicle.

It is clear that the guard plate, as installed using a kit onto a vehicle's door, creates additional security preventing theft of the car through a "jimmying" of the automobile's locking mechanism.

What is claimed is:

1. An improved automobile handle and locking assembly comprising:

a) a locking mechanism for securing an automobile door to an automobile free;

b) a handle mechanism being in mechanical communication with said locking mechanism via an automobile lock activation mechanism, said handle mechanism being secured to said automobile door; and, c) a guard plate interposed between said handle mechanism and said automobile door, said guard plate having, 1) a first plate having flanges around its periphery and a first opening therein, 2) a second plate being substantially parallel to said first plate and contained within the flanges of said first plate and having a second opening being substantially complementary to said first opening;

3) a vertical member being arranged generally perpendicular to said second plate and attached to a selected edge of said first opening and said second opening.

2. The improved automobile handle and locking assembly according to claim 1 wherein said first plate, said second plate, and said vertical member are bonded to each other.

3. The improved automobile handle and locking assembly according to claim 2 further including a clip attachment mechanism and wherein said second plate includes a clip receiving means for receiving said clip attachment mechanism for securing said guard plate to the door of the automobile.

4. The improved automobile handle and locking assembly according to claim 3 wherein said vertical member includes tab means for securing said guard plate to said automobile handle through a sliding action therebetween.

5. The improved automobile handle and locking assembly according to claim 4 wherein said vertical member includes a protection collar means for at least partially enclosing said automobile lock activation mechanism.

6. The improved automobile handle and locking assembly according to claim 5 wherein said vertical member includes a fastener opening for receiving a fastener means for securing said guard plate to said automobile handle.

7. The improved automobile handle and locking assembly according to claim 6 wherein said clip receiving means is located at a first end of said second opening and said fastener opening is proximal to an opposite second end of said second opening.

8. A guard plate for a handle of an automobile comprising:

a) a first plate having flanges around its periphery and a first opening therein;

b) a second plate being substantially parallel to said first plate and contained within the flanges of said first plate and affixed to said first plate prior to application of said guard plate to said handle and said automobile and having a second opening being at least partially complementary to said first opening;

c) a vertical member being arranged generally perpendicular to said second plate and attached to a selected edge of said first opening and said second opening and wherein said vertical member includes tab means for securing said guard plate to an automobile handle through a sliding action between said automobile handle and said guard plate.

9. The guard plate according to claim 8 wherein said first plate, said second plate, and said vertical member are bonded to each other.

10. The guard plate according to claim 9 wherein said second plate include a clip receiving means for receiving a clip attachment means.

11. The guard plate according to claim 10 wherein said vertical member includes a protective collar means.

12. The guard plate according to claim 11 wherein said vertical member includes a fastener opening for receiving a fastener means for securing said guard plate to said automobile handle.

13. The guard plate according to claim 12 wherein said clip receiving means is located at a first end of said second opening and said fastener opening is proximal to an opposite second end of said second opening.

14. A guard plate kit for a handle being mounted on a door of an automobile comprising:

a) a guard plate having, 1) a first plate having flanges around its periphery and a first opening therein, 2) a second plate being substantially parallel to said first plate and contained within the flanges of said first plate and having a second opening being partially complementary to said first opening, said second plate further having a clip receiving means for receiving a clip fastener for securing said guard plate to a body of an automobile, and, 3) a vertical member being arranged generally perpendicular to said second plate and attached to a selected edge of said first opening and said second opening and wherein said vertical member includes tab means for securing said guard plate to an automobile handle through a sliding action therebetween; and, b) a clip fastener.

15. The guard plate kit according to claim 14 wherein said first plate, said second plate, and said vertical member of said guard plate are bonded to each other.

16. The guard plate kit according to claim 15 wherein said vertical member includes a protective collar means for at least partially enclosing an automobile lock activation mechanism.

17. The guard plate kit according to claim 16 wherein said vertical member includes a fastener opening for receiving a fastener means for securing said guard plate to said automobile handle.

18. The guard plate kit according to claim 17 wherein said clip receiving means is located at a first end of said second opening and said fastener opening is proximal to an opposite second end of said second opening.

* * * * *